United States Patent [19]

Földi et al.

[11] Patent Number: 4,833,577

[45] Date of Patent: May 23, 1989

[54] LIGHT SOURCE IN A SUBDIVIDED ARRANGEMENT

[76] Inventors: Tivadar Földi, Irinyi u. 36/b. H-1117; Gábor Biró , Gönczy u. 2. H-1093; Tamás Barna, Ady E. u. 9/d. H-1024; Imre Nagy, Béla u. 9/2. H-1165, all of Budapest, Hungary

[21] Appl. No.: 244,561

[22] Filed: Sep. 12, 1988

Related U.S. Application Data

[63] Continuation of Ser. No. 166,783, Mar. 2, 1988, abandoned, which is a continuation of Ser. No. 859,614, May 5, 1986, abandoned.

[30] Foreign Application Priority Data

May 14, 1985 [HU] Hungary ..... 1819/85

[51] Int. Cl.[4] ..... F21V 7/00

[52] U.S. Cl. ..... 362/247; 362/225; 362/260; 313/581; 315/137

[58] Field of Search ..... 362/211, 217, 222, 225, 362/247, 260, 350; 315/137, 144, 146, 147; 313/581

[56] References Cited

U.S. PATENT DOCUMENTS

| | | | |
|---|---|---|---|
| 1,678,092 | 7/1928 | Wood | 362/211 |
| 2,195,114 | 3/1940 | McCarthy | 315/225 |
| 2,565,110 | 8/1951 | Adams | 315/144 |
| 3,169,213 | 7/1962 | Shaheen | 315/137 |
| 4,183,077 | 1/1980 | Arnold | 362/225 |

*Primary Examiner*—Samuel Scott
*Assistant Examiner*—Noah Kamen
*Attorney, Agent, or Firm*—Schweitzer & Cornman

[57] ABSTRACT

A light source having a single glass bulb housing and a multiple of three electrically interconnected fluorescent tubes. The tubes are located outside of the focal point of a smooth curved mirror. The phases of the fluorescent bulbs are electrically overlapped so as to substantially eliminate flickering of the light and to maximize the light intensity.

2 Claims, 2 Drawing Sheets

LIGHT SOURCE IN A SUBDIVIDED ARRANGEMENT

This is a file wrapper continuation of application Ser. No. 166,783, filed Mar. 2, 1988; which is a file wrapper continuation of application Ser. No. 859,614, filed on May 5, 1986, both now abandoned.

BACKGROUND OF THE INVENTION (1) Field Of The Invention

The present invention relates to a subdivided, yet composite, light source arrangement being particularly well suited for intensively illuminating a large space or area. Parallel light beams being emitted by individual fluorescent lamps, having relatively small diameters, if arranged according to the present invention result in simple and successful high intensity lighting for the theater and for scenery techniques. If the present invention is used to light open-air performances, the lights are more in the nature of a floodlight and can be used for providing a source of remote light covering a wide area or, spot or directed light emitted from a remote source.

(2) Description Of The Prior Art

It is a well-known fact that a filament, heated and arranged in a bulb, formed the first step of producing electrical powered light. This early solution provides a light of the intensity of about twenty lumens per watt. This prior art and ordinary incandescent bulb can be inexpensively and mass-produced. Even today, this type of bulb has application in several fields.

However, it must be recognized that the relatively weak lamp power limits the field of application of this incandescent electrical bulb. Where increased lighting requirements and intensive illumination are required, the solution provided by the incandescent, heated filament, ordinary light bulb is simply not adequate.

Recognizing the limitations of the incandescent ordinary light bulb, light sources of the fluorescent or plasma character have developed and provide significant advantages. These fluorescent or plasma-type illumination bulbs are operated on the basis of gas discharge. The light which is emitted as a result of operation of this type of bulb is in the range of about eighty-five lumens per watt. Operating conditions for the fluorescent type bulbs, defined by a flickering or variation of light in accordance with a sine curve, results in a predetermined periodicity in the intensity of illumination and, therefore, synchronization of two or more of the light bulbs becomes imperative for maximizing their use.

If, for example, three fluorescent-type bulbs are simultaneously used as a single light source and they are connected to separate phases of electrical power, uniform, i.e., low flickering illumination can be achieved to about ninety-five percent (95%). The intensity of illumination or uniformity of illumination can be, however, further increased by means of use of different individual mirrors for each bulb having a curved surface. This solution, however, is not totally advantageous since the three light bulbs, with their individual glass-like bulb housings, require a higher expense per bulb than where three sources of illumination are housed in a single glass bulb. Accordingly, costs per unit of illumination are correspondingly higher, the operational safety of the overall illumination system decreases and, at the same time, the light intensity remains between given limits and cannot be further increased.

SUMMARY OF THE INVENTION

The aim of the present invention is, therefore, to develop a subdivided composite arrangement of multiple light sources which is free of the previously-described deficiencies or disadvantages. The present invention relates to the application of a multiple number of fluorescent bulbs which are so situated so as to provide high intensity light at relative minimal unit costs, which can be used for spotlight purposes, i.e., where a directed source of illumination is desired or, alternatively, as a floodlight where a broader range of area illumination is required as, for example, in theater production.

A further aim sought to be accomplished by the present invention is the spot or point type illumination which can be obtained by use of mirrors with the fluorescent type bulbs or, alternatively, a floodlight can be obtained by utilizing large dimensioned mirrors.

In accordance with the present invention, therefore, the aim of the present invention is achieved by a light source arrangement consisting of a plurality of fluorescent tubes or members. The radiating parts of the illumination members, i.e., the fluorescent portion of the tubes are arranged so that they all lie outside of the optical axis and/or the symmetry lines of a symmetrical, often parabolic main mirror. In the case of a mirror surface which is shaped to conform to a mathematical relationship of a higher order of magnitude, i.e. more complex than a simple symmetrical curved mirror, the sources of light are preferably located on the surface corresponding to the focus of the more complex mirror.

According to the preferred embodiment of the present invention, three fluorescent light sources can be housed in a single bulb and electrically connected together such that their phases maximize the intensity and uniformity of illumination. It is also contemplated to arrange the fluorescent bulbs, without a glass bulb housing. This latter solution has the advantage of quicker cooling when the fluorescent light tubes are turned off and, where frequent switching of the light sources "on" and "off" and "on" again is anticipated, the provision of multiple light sources without a glass bulb housing provides better cooling, with less difficulties.

On the other hand, however, the multiple light sources can be housed in a common bulb and, in this manner, assembly and operation of the overall bulb is facilitated.

In the embodiment of the present invention wherein the number of light sources is more than two, it is considered advantageous for the light sources to be electrically interconnected in multiples of three. The solution, according to the present invention, is described below in detail as well as is the preferred embodiment of the present invention and the drawings are to be read and considered in connection with the description.

DETAILED DESCRIPTION OF THE DRAWINGS AND THE PREFERRED EMBODIMENT

Figure 1:
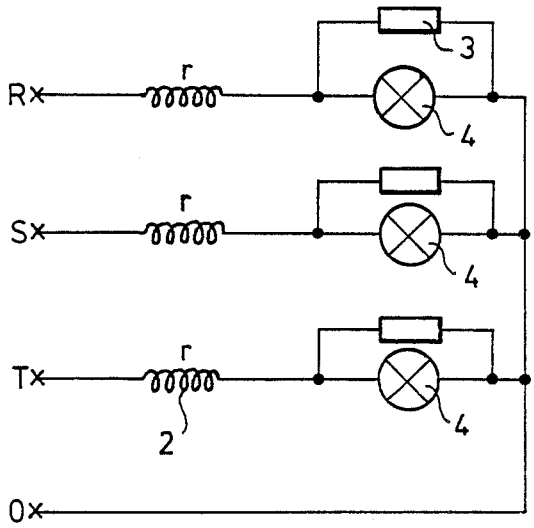
FIG. 1 is an electrical schematic of a bulb having three electrically interconnected fluorescent tube elements, arranged according to the present invention.
Figure 2:
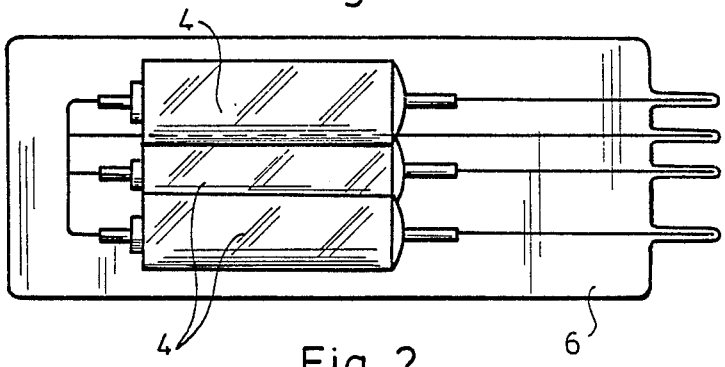
FIG. 2 is a top plan view of a bulb having three fluorescent light tubes housed within a single bulb and showing, on one side, a means for connecting the bulb into an electrical power supply or socket.

With reference to FIG. 1, three separate light sources 4, formed as active plasma bodies or fluorescent light emitting tubular elements, are arranged to form a single bulb (see FIG. 2). One of the ends of each of the light sources 4, through resistors 2 (known in the prior art) are connected to the electrical phases R, S, and T of a power supply. The other ends of the light sources 4 are electrically interconnected to one another and connected to the O-point of the phases of current via a common electrical line. All of the light sources 4 are provided with an electrical starter or ignitor 3, itself also well-known in the art relating to fluorescent lights.

Due to this arrangement, the resulting light emitted by the bulb is practically free of intermittent flashing since the phases of the electrical power are overlapped. Obtaining a flash-free fluorescent light is most advantegeous in film producing as there is a general need for higher light intensity without the negative effects of flashing ordinarily associated with fluorescent bulbs.

Generally, a discharge tube of 50 Hz is used in connection with film production. A camera having a shooting speed of about 24 film frames per minute is also usually used. This, then, means that a dark strip corresponding to about 1 Hz is "sliding" during the shooting sequence. For this purpose, therefore, the camera has to be synchronized to a special quartz oscillator and this, clearly, requires a considerable technical and monetary expenditure. The deficiency of this "sliding" can be eliminated by the flash-free, resultant illumination of the present invention, as described herein.

Figure 3:
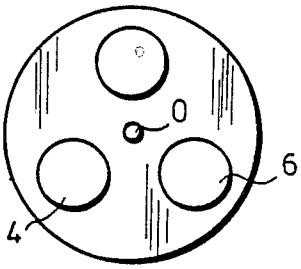
FIG. 3 is an end view of the bulb shown in FIG. 2, looking from the left of FIG. 2 toward the bulb.
Figure 4:
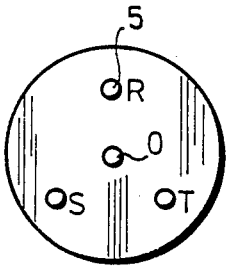
FIG. 4 is another end view of the bulb shown in FIG. 2 with this view being taken from the right side of the bulb shown in FIG. 2.
Figure 5:
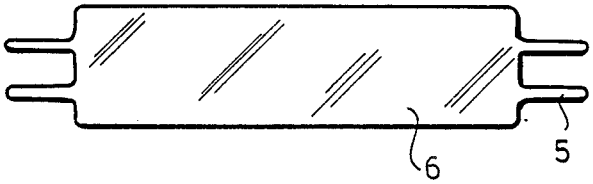
FIG. 5 is an overall outline of a bulb made according to the present invention with bilateral extending connecting arms for installing the bulb into a suitable electrical power supply or socket.
Figure 6:
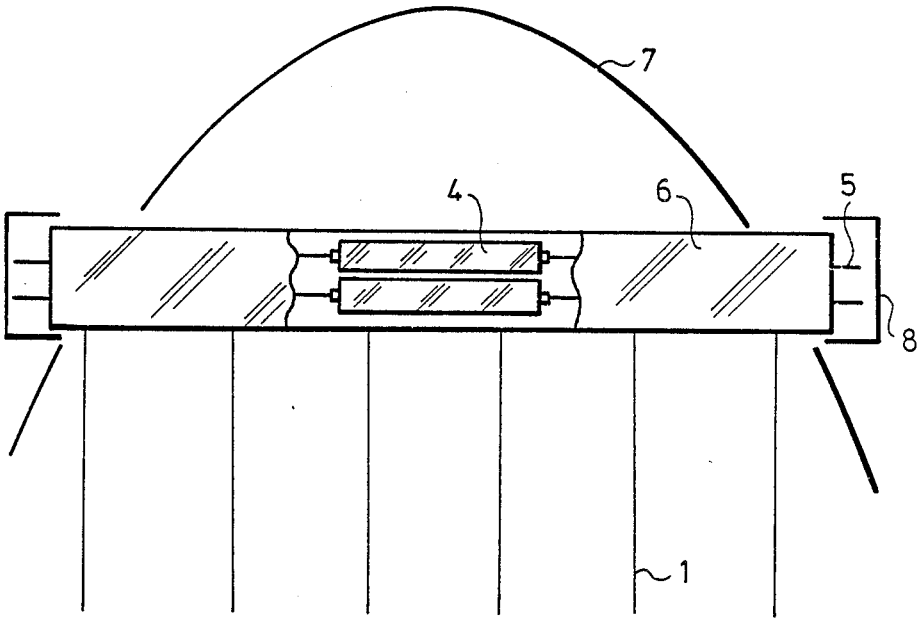
FIG. 6 shows the arrangement of the present invention with the bulb, but not the tubes, installed at the focal point of a parabolic shaped mirror; and, FIG. 7 illustrates the bulb, containing multiple fluorescent light tubes or sources, in association with a parabolic-shaped mirror for producing a headlight.
Figure 7:
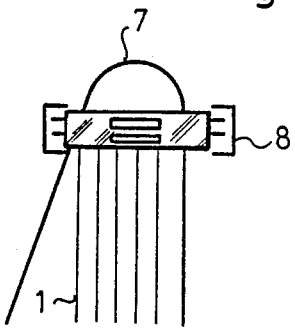

FIGS. 2 through 4 show three symmetrical fluorescent light tubes 4 installed into a single bulb 6. The tubes, schematically illustrated, are interconnected to one another and then connected to the phases shown schematically in FIG. 1. In this embodiment, the armatures 5 of the bulb are arranged on one side of the bulb (see FIGS. 2 through 4) in a manner quite similar to that which was previously used in connection with radio tubes. It is also possible to form the bulb 6 so that the armatures 5 extend bilaterally. In this embodiment, the arms are capable of being received into a bayonet-type socket, in much the same manner as is presently used with fluorescent tubes. A form of bilateral armature extension is shown in FIGS. 5 through 7. In addition, however, FIGS. 6 and 7 show the arrangement of the bulb housing, having multiple fluorescent light tubes contained therein with bilateral armatures located in connection with a parabolic mirror 7. The density of the light bundle 1 is dependent on the shape of the light sources 4. The bulb housing is arranged in the focal point of the mirror 7 or, alternatively, proximal to the mirror. The individual tubes, however, are outside of the focal optical point of the mirror. In such a manner, the scattered illumination, headlight, or other light bundle of optional character can be obtained in a simple and efficient manner.

What we claim:

1. A lamp comprising;

(i) a plurality of elongated fluorescent tubes disposed substantially parallel to each other within a single lamp envelope and each tube having electrical connection means adapted to be connected to an alternating power source, whereby each tube can be driven out of phase to produce uniform, flicker-free illumination; and (ii) an elongated mirror having the shape of a rotational paraboloid, said tubes being disposed perpendicularly to the axis of symmetry of said mirror and disposed about the focal point of said mirror.

2. The lamp of claim 1, wherein said plurality is three, or a multiple of three.

* * * * *

UNITED STATES PATENT AND TRADEMARK OFFICE

CERTIFICATE OF CORRECTION

PATENT NO. : 4,833,577

DATED : May 23, 1989

INVENTOR(S) : Tivadar Foldi, et al.

It is certified that error appears in the above-identified patent and that said Letters Patent is hereby corrected as shown below:

Add to item 76 , on front page of patent, the following two inventors:

László Vincze, Uzsoki 13. H-1145
Oszkár Rihmer, Bajvivo u. 4. H-1027

Signed and Sealed this

Eleventh Day of December, 1990

*Attest:*

*Attesting Officer*

HARRY F. MANBECK, JR.

*Commissioner of Patents and Trademarks*